US006350940B1

(12) United States Patent
Upchurch et al.

(10) Patent No.: US 6,350,940 B1
(45) Date of Patent: Feb. 26, 2002

(54) FRETTED/FRETLESS STRINGED MUSICAL INSTRUMENT

(76) Inventors: N. Roger Upchurch, 548 Jones St., Ventura, CA (US) 93003; Barry W. Bross, 1213 Alabama St., #4, Huntington Beach, CA (US) 92648

( * ) Notice: Subject to any disclaimer, the term of this patent is extended or adjusted under 35 U.S.C. 154(b) by 0 days.

(21) Appl. No.: 09/692,882

(22) Filed: Oct. 23, 2000

(51) Int. Cl.[7] ..... G10D 3/06
(52) U.S. Cl. ..... 84/314 R; 84/293; 84/290
(58) Field of Search ..... 84/314 R, 293, 84/290

(56) References Cited

U.S. PATENT DOCUMENTS 4,297,936 A * 11/1981 Mouton ..... 84/314 R
4,722,260 A * 2/1988 Pigozzi ..... 84/314 R
4,777,858 A * 10/1988 Petschulat et al. ..... 84/314 R
5,325,757 A 7/1994 Ghenea

* cited by examiner

*Primary Examiner*—Shih-Yung Hsieh
(74) *Attorney, Agent, or Firm*—A. M. Fernandez

(57) ABSTRACT

A stringed instrument intended to be alternately played in a fretted mode or an unfretted mode by raising a separate fingerboard to the tops of the frets for the unfretted mode and lowering it for the fretted mode. A pair of meshed rack-and-pinion assemblies are driven back and forth by a lever the motion of which racks are translated to rails that cam the separate fingerboard up and down through pins protruding inwardly from the rails into slide slots in flanges of the fingerboard.

3 Claims, 5 Drawing Sheets

FRETTED/FRETLESS STRINGED MUSICAL INSTRUMENT

FIELD OF THE INVENTION

This invention relates to stringed musical instruments of the type that may be selectively played in the fretted and unfretted mode, and more particularly to means for converting such an instrument from one mode to the other without affecting the playing "action" of the instrument in terms of the distance each string must travel when pressed down to obtain the tuned pitch of a note in either the fretted or unfretted mode.

BACKGROUND OF THE INVENTION

A stringed musical instrument is one having a substantially flat sound box across which strings are strung and a long neck connecting the box to a tuning head where pegs are mounted for tuning the individual strings. The strings pass either over a sound opening on the front of the box or between a pair of sound openings, for example, or simply pass over a sound transducer at or near the surface of the box in the case of an electronic instrument, such as an electronic guitar. The instrument is played by strumming or plucking the strings with one hand while selecting the pitch of a musical note to be made by the strings engaged with the other hand by pressing them down at selected positions along a fingerboard on the neck, normally with only the fingers, hence the term "fingerboard."

In the case of a fretless instrument, the fingers press the selected strings against the fingerboard at locations that will then cause the strings to produce desired notes, each with a desired pitch, but in the case of a fretted instrument, the fingers press the strings against selected lateral bars or frets spaced longitudinally along the fingerboard. In that case, a pressed string produces a tone of a well defined pitch. In other words, frets influence the tonal character of the pitch to be very sharp and clearly defined, whereas the tonal character of the pitch produced on a fretless fingerboard is softer and less defined, thus producing a more swelling type of sound. This is so because the point of pressing the string against the fingerboard is not so well defined as in the case of pressing the string against a fret, the top of which is fixed to be above the surface of the fingerboard.

It is customary to use one or the other of the fretted and fretless types of instruments according to the nature of the music to be played, but sometimes it is desirable to switch from one type of instrument to the other on the same instrument in the middle of the piece of music being played. Consequently, it would be desirable to have both options available in one instrument by providing some means for effectively removing the frets quickly at the option of the musician, such as by switching a lever at the instrument head from one position to another, as shown in U.S. Pat. No. 5,325,757. That theoretically makes it possible for playing the instrument alternately in the two modes, fretted and fretless. However, once the instrument strings are tuned in the fretted mode (while the tonal characteristic of the instrument is very sharp and clearly defined), that prior-art instrument responds well only while being played in the fretted mode.

While playing that prior-art instrument in the unfretted mode, i.e., with the frets retracted into the neck, the distance the strings must travel increases when pressed down to obtain desired notes. As a result, the musician will find it more difficult to press the strings in the unfretted mode in order to play desired notes. Furthermore, the musician will find that the pitch of the notes produced in the unfretted mode increases from the tuned pitch produced by the same finger position used while playing the instrument in the fretted mode. In addition, the musician will need to adjust the position of the fingers to compensate for the increase/decrease in pitch of the notes when switching between the two modes. The result is that the musician is presented with an insurmountable "action" problem.

An object of this invention is to provide a fretted/fretless string instrument without this "action" problem so that the instrument will allow switching between its two modes while playing the same piece of music.

STATEMENT OF THE INVENTION

In accordance with the present invention, a fretted/fretless string instrument is provided with means for switching between its fretted and unfretted modes by rigidly securing the frets in the neck of the instrument with the frets protruding through spaced slots in a separate fingerboard between the strings and the neck. That separate fingerboard, provided with flanges extending over the sides of the neck, is implemented as a rigid board having a slightly curved surface between its flanges as is customary for string instruments, and is supported over the neck by two rails, one over each flange, having inwardly protruding pins that fit into spaced slide slots in the flanges. The rails are in turn supported on the neck by spaced screws that pass through horizontal slots in the rails and vertical slots in the flanges. The horizontal screw slots in the rails allow the rails to be driven back and forth relative to the neck while the vertical screw slots in the fingerboard flanges restrain the fingerboard to movement up and down relative to the neck as the rail pins protruding inwardly into the slide slots are driven back and forth between end portions of the slide slots oriented parallel to the neck and a sloped portion between the parallel and offset end portions. The extent that the parallel end portions are offset from each other in a vertical direction with respect to the neck determines the limits of up and down movement up to a position flush with the tops of the frets for the fretted mode down to a position preferably near the neck with a predetermined space between the neck and fingerboard. The advantage of this arrangement of raising a separate fingerboard up, vis-a-vis the prior art arrangement of lowering the frets in a fingerboard integral with the neck, is that the distance the strings must travel while playing the tuned instrument in the fretless mode remains the same for the same notes with the same pitch as when the fingerboard is lowered for playing in the fretted mode, thereby avoiding the "action" problem of the aforesaid prior-art instrument noted above.

Thus, the separate fingerboard is provided with slots through which the frets protrude upwardly toward the strings for playing in the fretted mode while the separate fingerboard is in its lowered position, preferably a minimum space away from the neck. For the fretless mode, the separate fingerboard is raised so that it is even with the tops of the frets. This second position of the separate fingerboard flush with the tops of the frets provides a fretless fingerboard with a play action indistinguishable from a fretted fingerboard, thereby allowing the musician to play the instrument without an "action" problem.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
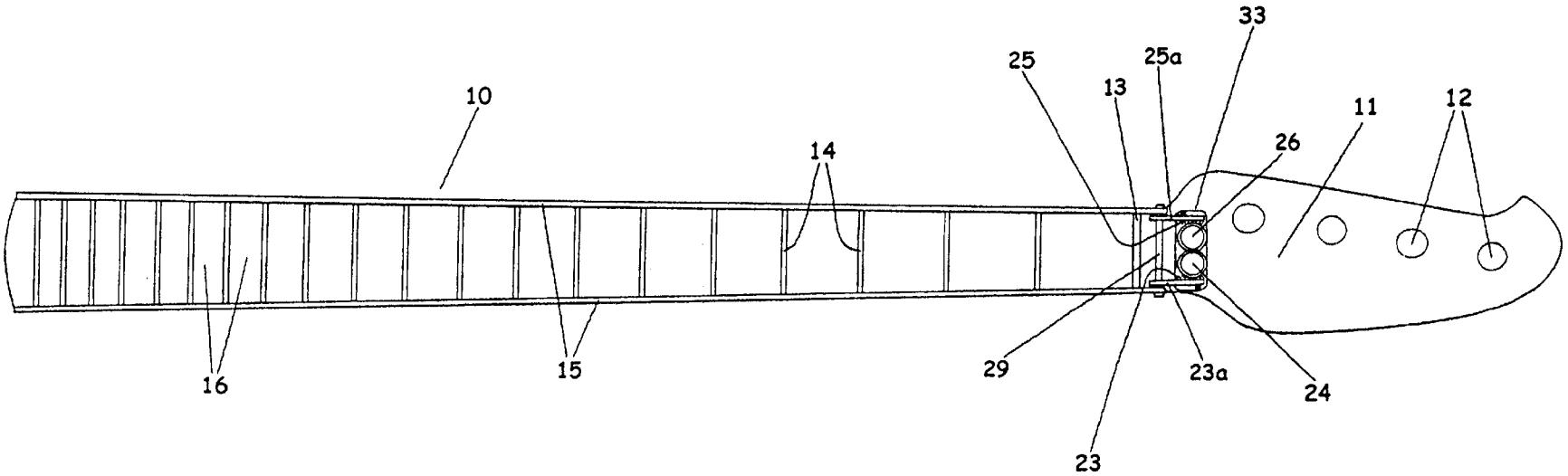
FIG. 1 is a plan view of the neck and head of a stringed instrument embodying the present invention, but without strings.

Referring to FIG. 1, the neck 10 of a stringed instrument is shown without a body.

Figure 4A:
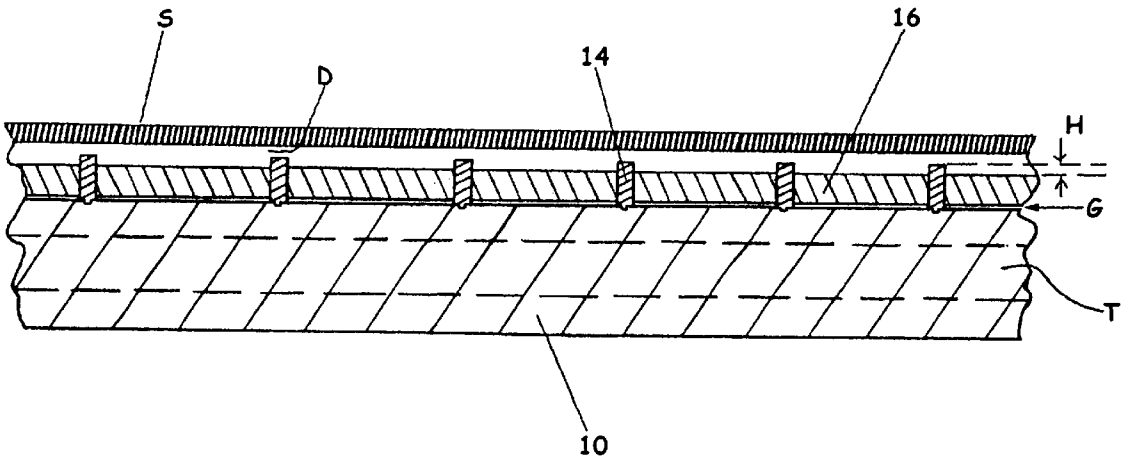
FIG. 4A is a longitudinal cross-section of the neck and fingerboard shown in FIG. 3A now shown with a taut bass string over the frets, i.e., shown in the fretted mode.

A head 11 serves to hold tuning pegs (not shown) for taut strings (also not shown) indicated to be four in number by the number of holes 12 for the pegs. The number of strings, which may vary depending on the particular type of instrument, is not critical to the invention. The four strings S1 to S4 shown only in FIGS. 4A,B and 5A,B are anchored at a position on the guitar body (not shown) on the far side of a sound opening relative to the neck and there held away from the front of the body by a bar secured on the surface of the body. A bar 13 at the far end of the neck 10 proximate the head 11 holds the strings away from the neck 10 such that they are held a set distance D above frets 14 fixed in position on the neck 10 as shown in FIGS. 4A,B and 5A,B.

Figures 2A, 2B:
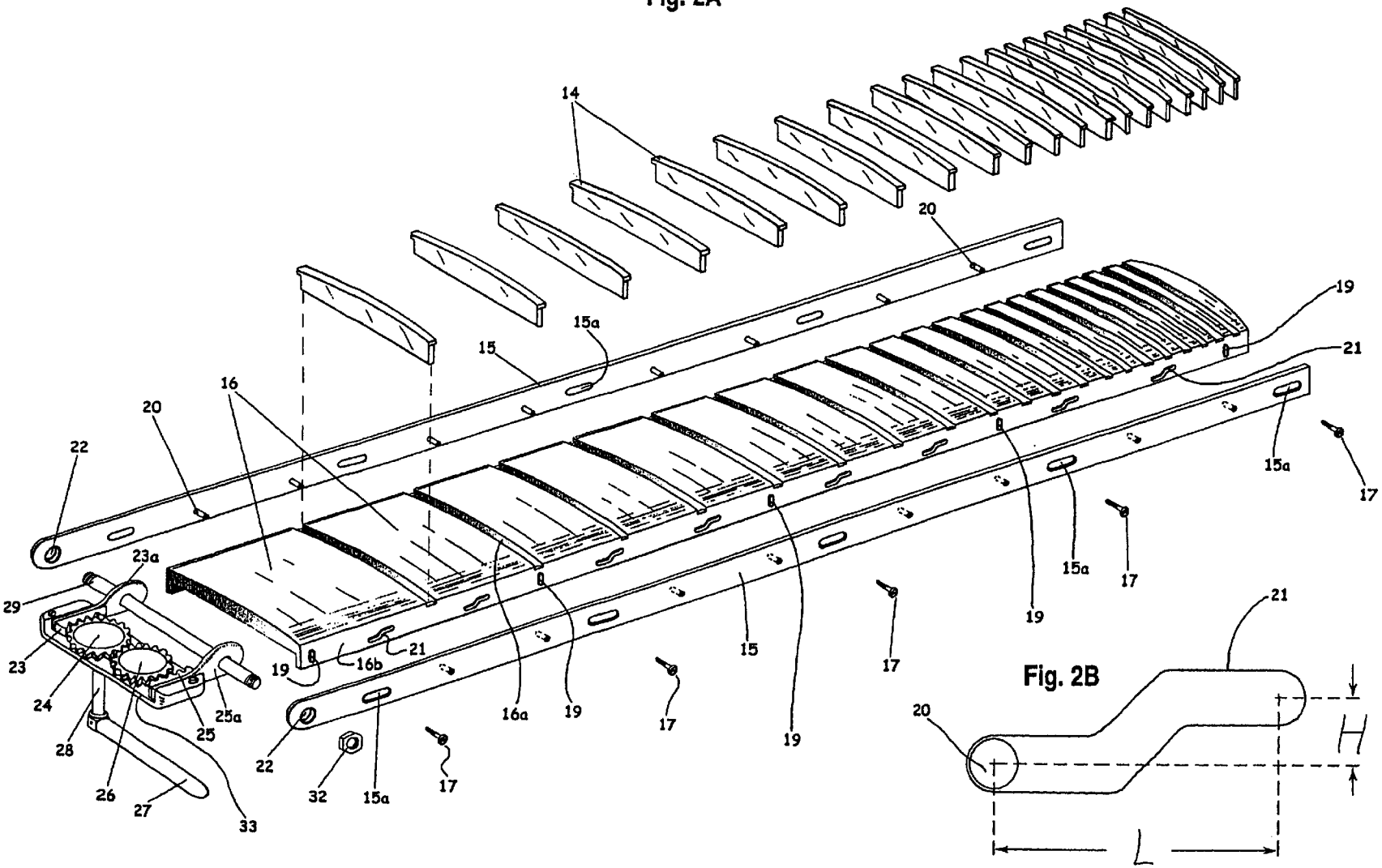
FIG. 2A is an exploded isometric view of the neck shown in FIG. 1.
FIG. 2B is a diagram of camming "slide" slots in side flanges of a fingerboard that is separate from the instrument neck.
Figure 4B:
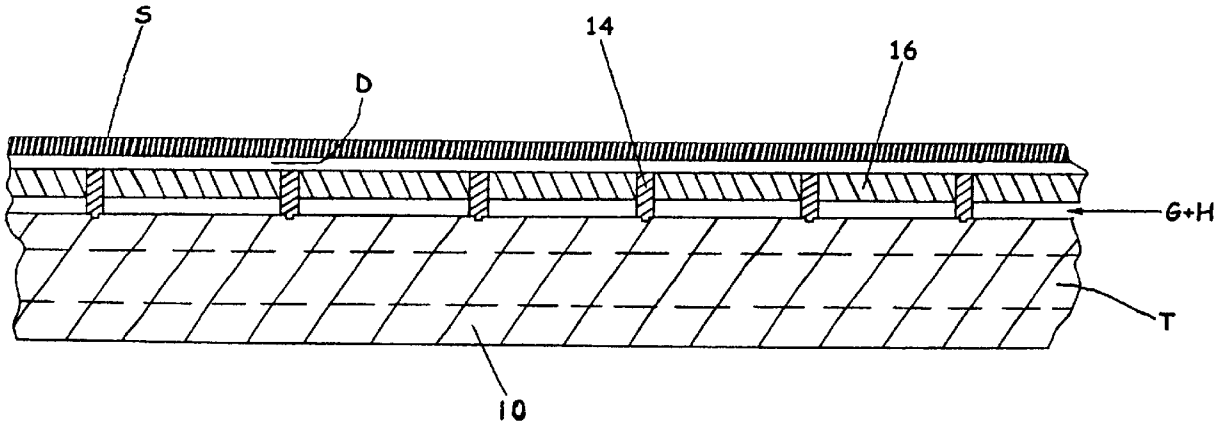
FIG. 4B is a longitudinal cross-section of the neck and fingerboard shown in FIG. 3B now shown with a taut bases string over the fingerboard and the fingerboard flush with the frets, i.e., shown in the fretless mode.
Figure 5A:
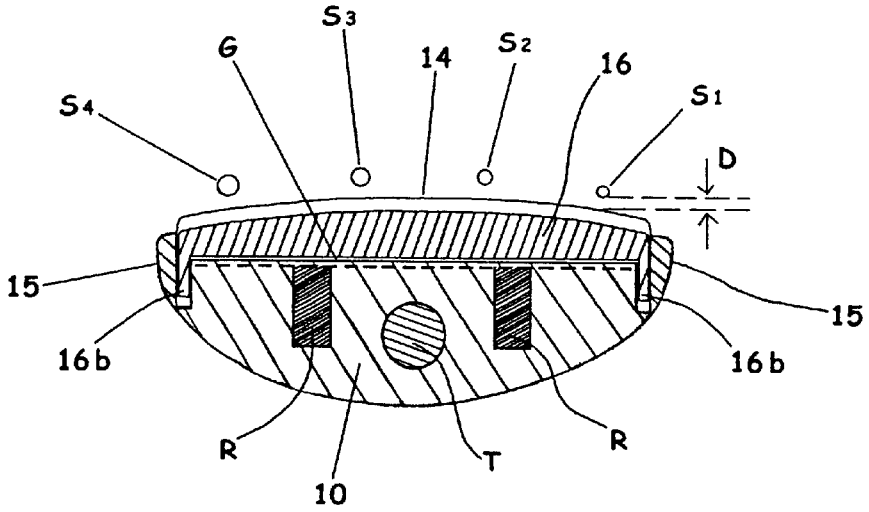
FIG. 5A is a lateral cross-section of the neck and fingerboard shown in FIG. 4A.
Figure 5B:
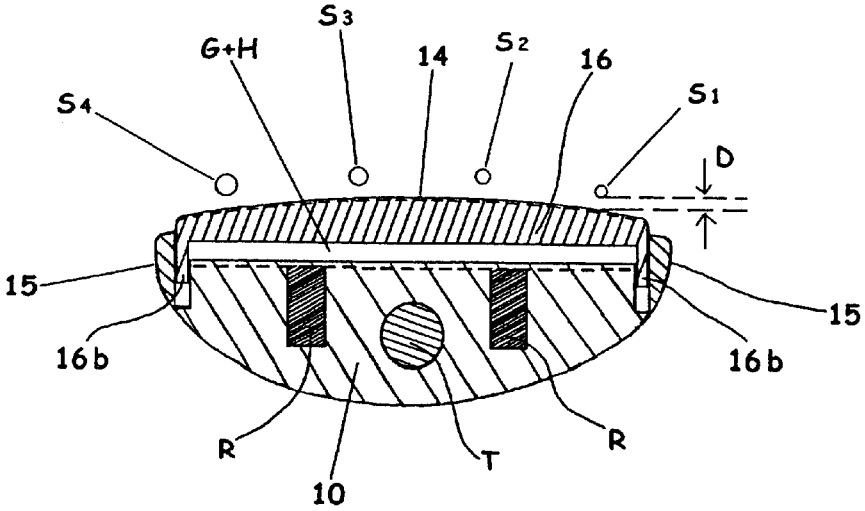
FIG. 5B is a lateral cross-section of the neck and fingerboard shown in FIG. 4B.

A rigid drive rail 15, such as of aluminum, brass or plastic secured on each side of the neck to selectively position a fingerboard 16 implemented as a separate strip of hard wood or metal over the neck 10 in one of two selectable positions, up or down. The down position is flat almost against the neck with a minimum gap G, as shown in FIGS. 4A and 5A, with the frets 14 protruding through slots 16*a* in the fingerboard 16, as shown in FIG. 2A. The down position is hereinafter referred to as the position of the fingerboard for the fretted mode of playing the instrument. The up position is with the surface of the fingerboard raised a distance H to a position flush with the top surfaces of the frets 14, as shown in FIGS. 4B and 5B. That up position is hereinafter referred to as the position of the fingerboard for the fretless mode of playing the instrument. This arrangement of the frets 14, two rails 15, and a separate fingerboard 16 may be better understood from the following description with reference to the exploded view in FIG. 2A.

Flanges 16*b* on both sides of the fingerboard 16 are provided to fit along the sides of the neck 10, as best shown in the cross-sectional views of the neck in FIGS. 5A and 5B, and to hold the fingerboard positioned over the neck by retaining screws 17 that pass through vertical slots 19 in the flanges 16*b*. The screws 17 also pass through horizontal slots 15*a* in the drive rails 15 oriented parallel to the length of the drive rail and therefore parallel to the neck 10 and fingerboard 16 so that the two drive rails 15 may slide back and forth on the retaining screws 17 in the longitudinal direction of the neck 10 but not in direction perpendicular thereto. The slots 15*a* of the rails 15 are countersunk to allow the heads of the retaining screws to be flush with or below the surface of the rails 15.

The rail retaining screws 17 also pass through vertical slots 19 in the fingerboard flanges 16*b* to reach the supporting neck 10. The vertical orientation of the slots 19 allow the fingerboard 16 to move only in a direction perpendicular to the neck 10 and the two drive rails 15. The separate fingerboard 16 is thus constrained from moving horizontally along the neck 10 by the rail retaining screws 17 passing through the vertical slots 19 in the fingerboard flanges 16*b*.

The position of the separate fingerboard 16 (up or down) on the neck 10 is controlled by pins 20 which protrude inwardly from the two drive rails 15 into "slide slots" 21 in the fingerboard flanges 16*b*. These slide slots are so named because their shape resembles the shape of a slide found on children's playgrounds, as viewed from the side, with horizontal end portions parallel to the two rails 15 and a sloped portion between the end portions as shown in FIG. 2B. As the drive rails 15 are driven in unison back and forth, guided by their horizontal slots 15*a*, the pins 20 protruding into the slide slots 21 cam the fingerboard up and down on the neck 10 as the pins are driven in the slide slots alternately to the left and right end potions as viewed in FIGS. 2A and 2B. The diameter of the pins 20 is selected for a close fit in the slide slots of horizontal length L as shown in FIG. 2B, and the length of the pins 20 is chosen to just engage the slide slots 21 in the flanges of the fingerboard 16 such that, while the drive rails 15 move horizontally back and forth, the fingerboard is cammed up and down by the pins 20 in the slide slots 21 in the fingerboard flanges 16*b*.

For example, if the pins 20 are in the upper right end portion of the slide slots 21, the pins hold the fingerboard 16 down so that its surface is below the top surface of the frets 14, leaving a minimum gap G between the neck 10 and the fingerboard 16, as shown in FIG. 4A, thus presenting a fretted instrument to be played. This minimum gap G is provided to prevent the possibility of the fingerboard chattering against the neck while the strings are played.

To change the fretted instrument to be played in the unfretted mode, the drive rails 15 are moved to the left, as viewed in FIG. 2A, causing the pins 20 in the slide slots 21 to cam the fingerboard 16 up as the pins move from the upper right end portions of the slots 21 to the lower left portions of the slots, thus raising the fingerboard 16 flush with the top surfaces of the frets. Because the screws 17 prevent horizontal motion of the fingerboard 16, the only motion of the fingerboard is vertical to the position shown in FIG. 4B and FIG. 5B. The reverse (downward) camming action of the pins 20 protruding into the slide slots 21 in the fingerboard flanges 16*b* is obtained by driving the rails to the right as viewed in FIG. 2A.

Figure 3A:
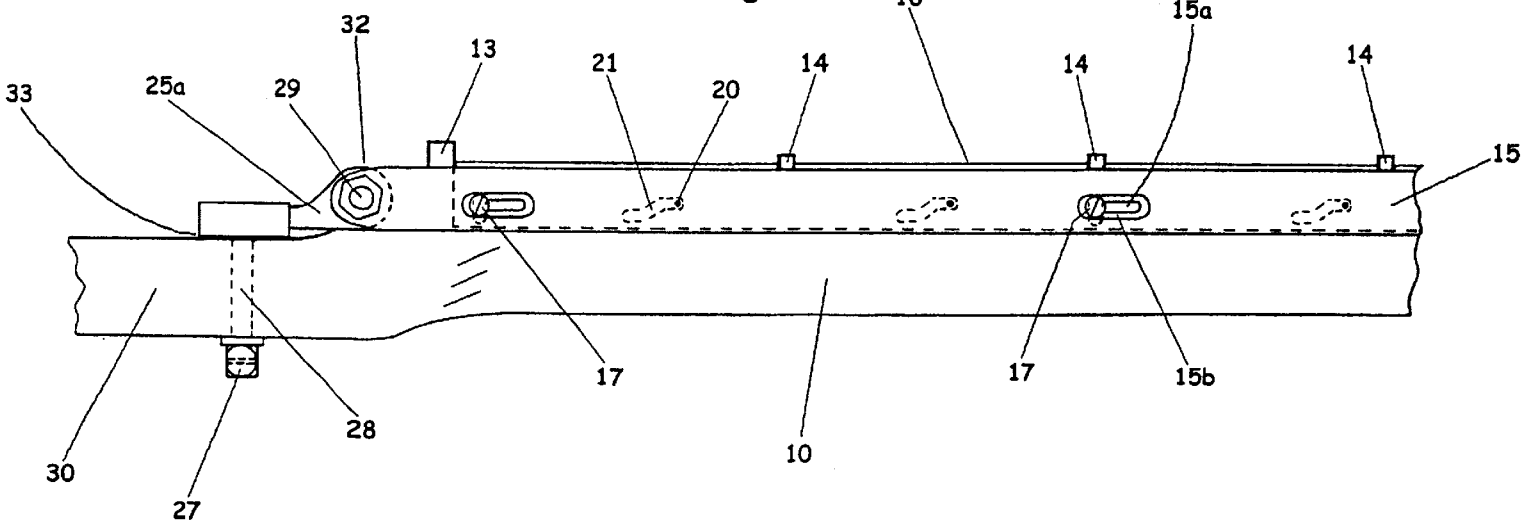
FIG. 3A is a side view of the neck shown in FIG. 2A with the fingerboard lowered for playing the instrument in the fretted mode.
Figure 3B:
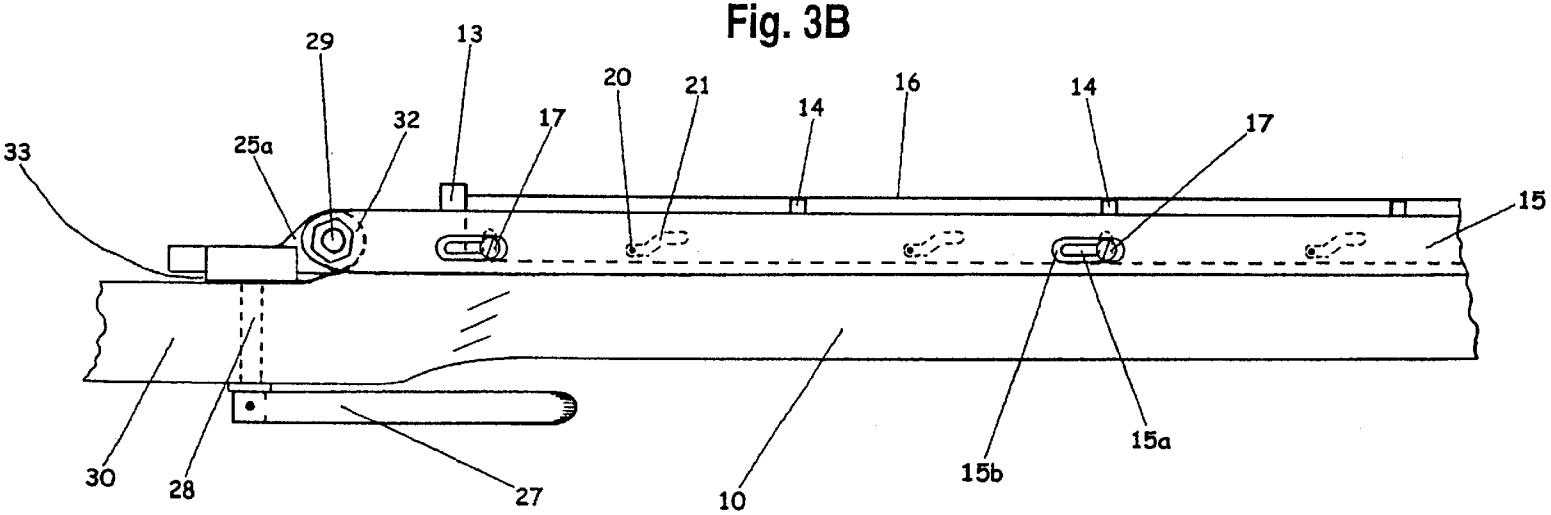
FIG. 3B is a side view of the neck shown in FIG. 2A with the fingerboard raised for playing the instrument in the fretless mode.

The means for driving the drive rails back and forth comprises a first rack 23 and pinion 24 and a second rack 25 and pinion 26 with the two pinions meshed together such that, when a lever 27 (connected to the pinion 24 through a shaft 28) is turned counterclockwise, the pinion 24 is turned counterclockwise and its rack 23 is driven back away from the fingerboard 16. The pinion 24 in turn drives the meshed pinion 26 clockwise to drive its rack 25 back in the same direction as the rack 23. Both racks thus driven in unison are connected to a transverse connecting rod 29 which passes through holes in tabs 23*a* and 25*a* connected to the respective racks 23 and 25 and through a hole in the rear end of each of the rails 15 to assure that they too move in unison in order to drive rails 15 with the pins 21 on both sides of the separate fingerboard 16 back from a high portion of slide slots 21 in the fingerboard flange 16*b* as shown in FIG. 3A and down a sloped portion into a low portion of the slide slots 21 as shown in FIG. 3B. In that manner, the fingerboard is cammed upwardly, i.e., raised from its down position shown in FIGS. 3A and 4A with frets 14 protruding through slots 16*a* in the fingerboard 16, to its up position shown in FIGS. 3B and 4B with its fingerboard 16 surface even with the tops of the frets 14, thus converting the instrument from the fretted mode to the fretless mode. When the lever is turned back from the position shown in FIG. 3B to the position shown in FIG. 3A, the camming action is reversed and the fingerboard is driven from the up position in FIG. 3B to the down position in FIG. 3A for again playing the instrument in the fretted mode. This can be done deftly without skipping a beat in the music being played by quickly manipulating the lever 27 using the hand on the neck and fingerboard.

Attention is now directed to the lowered position of the fingerboard 16 shown in the cross-sectional views of the neck 10 in FIGS. 4A and 5A. There a minimum gap G is shown between the fingerboard and neck not only to illustrate that the former is separate from the latter but also to emphasize that a minimum gap is necessary to avoid any vibration of the fingerboard against the neck, as noted hereinbefore. Also shown is a distance D between the strings (represented by the single string S4) and the fingerboard surface. When the fingerboard 16 is raised as shown in FIG. 4B, the gap G increases by the distance H that the fingerboard is raised, but the string distance D remains the same. In that manner, raising the fingerboard to convert the instrument to the unfretted mode of play instead of lowering the frets as in the prior art patent referenced hereinbefore, the "action" problem is obviated by this invention maintaining the distance D the same for both the fretted and unfretted modes of playing the instrument.

In practice, the space G in the fretted mode is minimized by milling the slide slots 21 in the fingerboard flanges so that the fingerboard 16 almost rests on the neck 10 leaving the minimum gap G. This requires the rack and pinion assembly mounted on the headstock 30 of the neck 10, as shown in FIG. 3A, with a transverse connecting rod 29 between the two rails 15 and the two racks 23,25 to be connected with precision to the ends 22 of the two rails. That connecting rod 29 may be implemented with a nut and bolt, or with a shaft threaded at both ends for receiving nuts, only one nut 32 being shown in FIG. 2A, To facilitate assembly of the two racks and pinions with the pinion teeth meshed, a U-shaped bracket 33 is employed to secure the racks 23 and 25 to the sides of that bracket in a meshed position relative to the respective pinions 24 and 26 with tabs 23*a* and 25*a* between the racks and the sides of the bracket. These tabs 23*a* and 25*a* may be made integral with the racks 23 and 25, or separate as shown. In the latter case, they are to be fused or welded to their racks so that they move back and forth as the racks are driven in unison by the meshed pinions 24 and 26.

Because of the importance of maintaining the distance H of the instrument strings above the frets 15 and of maintaining a minimum gap G between the fingerboard and the neck, the usual truss rod T shown in FIGS. 4A,B and FIGS. 5A,B is relied upon to compensate for any tendency of the neck to bend under the force of the taut strings. In addition to that, graphite rods R are embedded in the neck on both sides of the truss rod T, as shown in FIGS. 5A,5B.

In summary, the camming action required for raising and lowering the fingerboard for switching the mode of play from fretted to unfretted and vice versa is achieved by manually pivoting a lever to turn one of two meshed pinions in rack-and-pinion assemblies for driving in unison two drive rails, one on each side of the fingerboard adjacent to the two flanges on the sides thereof The flanges are held onto the neck of the instrument along its two sides by screws through horizontal slots in the drive rails and vertical slots in the flanges, where the terms "vertical" and "horizontal" define the orientation of the slots relative to the neck of the instrument. Those screws through vertical slots in the fingerboard flanges and the frets protruding through slots in the fingerboard hold the position of the fingerboard in its horizontal position over the neck while the horizontal slots for those screws allow the drive rails to move back and forth horizontally over the fingerboard flanges.

The fingerboard flanges have slide slots spaced along their length and the drive rails have spaced pins protruding inwardly into the slide slots. The side slots are shaped to have horizontal end portions with a sloped portion between those end portions. Consequently, as the drive rails are driven back and forth over the fingerboard flanges, the pins are driven back and forth over the sloped portions between the slide-slot end portions. In that manner, the drive-rail pins cam the fingerboard up and down over the instrument neck while the fingerboard is held in its horizontal position over the neck by the screws in vertical slots of the fingerboard slots and the frets protruding through the slots in the fingerboard between the flanges. The extent of the thrust of the drive rails, limited by their horizontal slots for the screws, is sufficient to drive the pins in the slide slots of the fingerboard flanges between the two end portions of the slide slots. The vertical spacing between those two end portions of the flange slide slots then define the height (the extent) of the up and down camming of the fingerboard. All elements involved in this camming action are coordinated in camming the fingerboard between its up position even with the tops of the frets and its down position with a minimum gap between the fingerboard and the neck. Those two up and down positions are set by the length and height of the fingerboard flange slide slots in coordination with the vertical slots in the flanges for the fingerboard holding screws.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. A stringed musical instrument having a neck, a body at one end of said neck and a head with pegs for tuning strings over said neck, said instrument intended to be alternately played in a fretted mode or an unfretted mode comprising:

said neck having frets affixed thereto over which strings of said instrument are tuned taut with a virtually uniform spacing of said strings above a top surface of said frets;

a separate fingerboard over said neck having slots for said frets to protrude through said fingerboard, said fingerboard positioned between said string and said neck in a position for playing said instrument in the fretted mode; and means for selectively raising said separate fingerboard over said neck to a position even with said top surface of said frets in response to pivotal motion of a lever in one direction for playing said stringed instrument in an unfretted mode and for selectively lowering said separate fingerboard for playing said instrument in a fretted mode in response to a pivotal motion of said lever in a direction opposite said one direction;

whereby spacing of said strings over said top surfaces of said frets remains constant for playing said instrument in both the fretted and unfretted modes.

2. A stringed instrument as defined in claim 1 including, two flanges extending from said separate fingerboard parallel to each other over the full length of said fingerboard, said flanges each having a plurality of spaced vertical slots perpendicular to said fingerboard and a plurality of spaced slide slots, each of said slide slots having a first horizontal end portion and a second horizontal end portion offset vertically from said first end portion and a sloped portion between said first and second end portions, two drive rails, one on each side of said separate fingerboard adjacent to a flange thereof, said drive rails each having a plurality of spaced horizontal slots, one opposite each spaced vertical slot and a plurality of pins protruding inwardly toward said flange of said separate fingerboard into a slide slot for camming said separate fingerboard up and down said sloped portions of said slide slots as said drive rail moves said pins from one end portion to another end portion, a plurality of screws for said flanges on both sides of said separate fingerboard, one screw for each flange vertical slot, and rail horizontal of said drive rail, adjacent one of said flanges of said one adjacent slot, said screws driven into said neck, thereby constraining said separate fingerboard to motion up and down with respect to the neck by said vertical slot in said flanges as said drive rails are restrained to horizontal motion as they are driven forth in unison along the length of said neck by two meshed rack-and-pinion assembly means mounted at an end of said neck adjacent said head, whereby said rail pins protruding into said slide slots constrained to horizontal motion cam said separate fingerboard up and down as said pins are driven from one horizontal end portion to the other through said sloped portion of said slide slots.

3. A stringed instrument as defined in claim 2 wherein said meshed rack-and-pinion assembly means comprises, two pinions meshed to turn together in opposite directions in response to rotation of one pinion in either direction, a lever attached to said one pinion for manually turning said one pinion in either direction, two racks, each meshed with a separate one of said two pinions on a side opposite the sides where the pinions mesh, each rack having a tab protruding in a direction toward said neck, a rod passing through a center of said tabs, and opposite ends of said rods passing through ends of said drive rails on opposite sides of said fingerboard flanges, whereby manipulation of said lever back and forth drives said drive rails back and forth to selectively raise and lower said separate fingerboard over said neck.

* * * * *